US006719130B1

(12) United States Patent
Wagner

(10) Patent No.: US 6,719,130 B1
(45) Date of Patent: Apr. 13, 2004

(54) PACKAGING SYSTEM FOR A PRODUCT PROVIDED BY MIXING TWO OR MORE COMPONENTS

(75) Inventor: George W. Wagner, Olkton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/299,093

(22) Filed: Nov. 18, 2002

(51) Int. Cl.[7] ..... B65D 25/08
(52) U.S. Cl. ..... 206/222; 215/6
(58) Field of Search ..... 206/0.5, 222; 215/6, 215/DIG. 8

(56) References Cited

U.S. PATENT DOCUMENTS 2,524,365 A * 10/1950 Smith ..... 206/222
2,527,992 A * 10/1950 Greenberg ..... 206/220
3,596,801 A * 8/1971 Barnack ..... 222/81
3,779,372 A * 12/1973 de Lloret ..... 206/222
3,802,604 A * 4/1974 Morane et al. ..... 222/83
6,655,524 B2 * 12/2003 De Laforcade ..... 206/222

* cited by examiner

*Primary Examiner*—John Sipos
*Assistant Examiner*—John Paradiso
(74) *Attorney, Agent, or Firm*—Ulysses John Biffoni

(57) ABSTRACT

A packaging system comprises a container including at least two compartments, and at least one opening in communication with at least one of the at least two compartments; a common wall or a septum dividing each of the at least two compartments, the common wall or septum being adapted for rupturing to enable the contents of each of the at least two compartments to be mixed together within the container; and a rupture mechanism operatively engaged with the common wall and actuable by a user, the rupture mechanism being adapted for rupturing the common wall or septum upon actuation by a user.

16 Claims, 2 Drawing Sheets

PACKAGING SYSTEM FOR A PRODUCT PROVIDED BY MIXING TWO OR MORE COMPONENTS

GOVERNMENTAL INTEREST

The invention described herein may be manufactured, used and licensed by or for the U.S. Government.

FIELD OF THE INVENTION

The present invention is generally related to a packaging system, and more particularly to packaging system for products having two or more active ingredients or components that must be mixed together before use.

BACKGROUND OF THE INVENTION

Some products such as household cleaners, dentifrices, adhesives, and the like, are composed of more than one active ingredient that must be mixed together only upon use. Such products generally require special handling and preparation. The active ingredients typically must be stored separately since the product formed from the mixing of the ingredients may be too unstable or short-lived to be properly stored over an extended period of time. The ingredients usually must be mixed in proper amounts prior to use. Accordingly, the storage and preparation of such products can be inconvenient and difficult.

Containers having multiple compartments for holding the active ingredients components have been used, and are known for years. These containers provide better storage features by holding the active components individually and separated from one another in a single package. Typically, the compartments of the container are arranged in a side-by-side configuration. The container may include single or multiple openings for dispensing the active components therefrom. A common household cleaner, which comprises two main active ingredients: bleach and hydrogen peroxide is packaged in such containers. The two active ingredients are especially reactive with one another, and need to be packaged separately. Hence, the bleach is stored in one compartment of the container and the hydrogen peroxide is stored in the other compartment. To formulate the household cleaner, the user dispenses the active components into a container where they are thoroughly mixed to produce the household cleaner product.

Although the containers described above provide better storage convenience, they provide little improvement in the preparation of the product from the mixing of active components. This is particularly important where the product must be formulated with differing ratio amounts of the active components, and/or where the product must be thoroughly mixed or blended in a separate container prior to use. Moreover, such prior art containers often fail to provide satisfactory results where the product must be prepared in a quick and rapid manner.

Accordingly, there is a need to provide a packaging system for a product having two or more active components or ingredients that are packaged into a single compact unit. There is a further need to provide a packaging system for a product having two or more active components that is especially well suited for facilitating the preparation and dispensing of the packaged product in an easy and rapid manner immediately before use. There is also a need to provide a packaging system for a product having two or more active components that provide substantial reduction in costs and mitigation of problems typically associated with the packaging, shipping and storage of such products. It would be especially desirable to provide a packaging system for a product having two or more active components, which can be used to conveniently facilitate mixing of the active components in specific preset ratio amounts upon actuation by the user, and thus avoid the need to measure the components or use a separate mixing container for better convenience and consistency in product quality.

SUMMARY OF THE INVENTION

The present invention is directed to packaging of a product having two or more active components or ingredients, which must be mixed together shortly before use. The packaging of the present invention generally comprises a container having at least two compartments, and an opening in communication with at least one of the at least two compartments, and a common wall or septum separating the at least two compartments from one another. The packaging of the present invention further includes a rupture mechanism operatively including the common wall or septum, and adapted to be actuated by the user to cause the common wall to rupture for permitting the contents of each of the compartments to intermingle and mix with one another in the resulting conjoined compartments.

In one particular aspect of the present invention, there is provided a packaging system which comprises:

- a container including at least two compartments, and at least one opening in communication with at least one of the at least two compartments;
- a common wall separating each of the at least two compartments, the common wall being adapted for rupturing to enable the contents of each of the at least two compartments to mix in a volume formed from the resulting conjoined compartments within the container; and
- a rupture mechanism operatively engaged with the common wall and actuable by a user, the rupture mechanism being adapted for rupturing the common wall upon actuation by the user.

BRIEF DESCRIPTION OF THE DRAWINGS

Various embodiments of the present invention are described in association with the following drawings, in which like items are identified by the same designation, wherein.

DETAILED DESCRIPTION OF THE INVENTION

Figure 1:
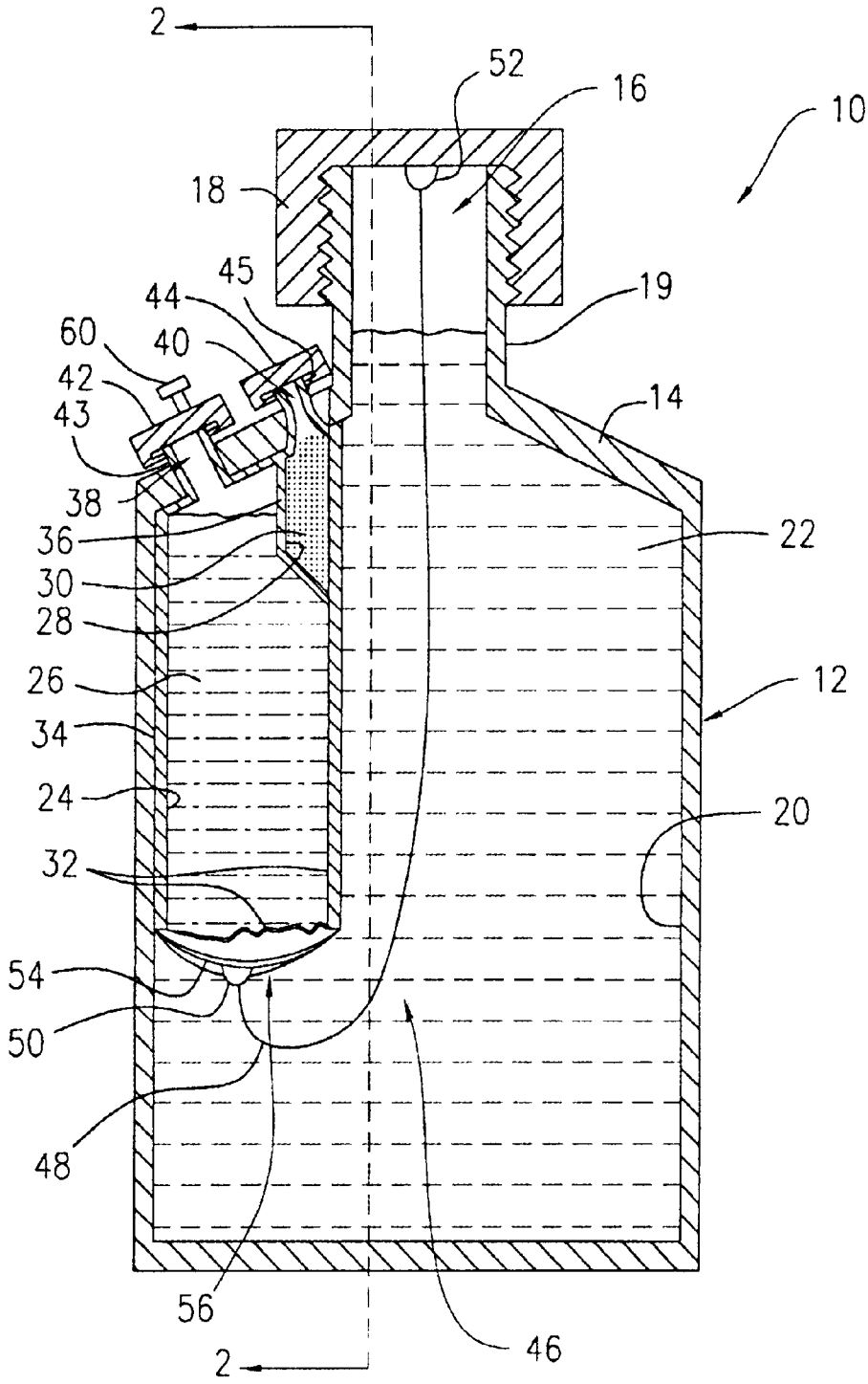
FIG. 1 is a cross sectional view of a container for one embodiment of the present invention.

The present invention is generally directed to a packaging system for a product having two or more active components or ingredients that must be kept separately apart prior to use. The active components of such products is mixed together prior to use. The packaging container of the present invention is adapted to provide an easy and convenient approach to the storage, preparation and dispensing of such products. The packaging of the present invention enables a user to quickly activate the product by mixing its ingredients together using minimal preparation steps or mental deliberation on the part of the user.

The present invention generally comprises a container including two or more compartments each configured to individually hold an active ingredient, respectively, that must be mixed together to produce a final mixed product, a common wall separating the two or more compartments from one another, the common wall being adapted for rupturing to permit the active ingredients to mix together in the resulting conjoined compartments, and a rupture mechanism operatively engaged with the common wall and actuable by a user for rupturing the common wall.

It is noted that the number and size of compartments provided by the packaging container of the present invention is not limited to the embodiment shown and described herein, and can include any number of the compartments each sized to accommodate the individual active components that must be mixed together to provide the desired mixed product for immediate use.

In accordance with the present invention, the rupture mechanism includes any suitable mechanism that can be easily actuated by a user to create a common volume into which the active components are released from their respective compartments and mixed together.

With each of the active components of the product to be packaged suitably contained in one of the compartments of the container of the present invention, the actuation of the rupture mechanism by the user initiates the contact and mixing of the previously separately contained active components within the now common volume within the container. In this manner, the user can thereafter dispense the resulting mixed product. Each of the compartments of the container can be configured to hold any type of mixable material or substance, and each can be suitably dimensioned to hold a specific ratio amount or volume necessary to provide a particular mixture combination. The components of the product to be packaged can be a flowable mixable material such as a gas or a liquid; a solid typically in the form of a powder or a particulate; a gel; an aerosol; a dissolvable solid; an effervescent solid; and the like.

In a general aspect of the present invention, there is provided a packaging system for a product having two or more active components, which comprises a container including at least two compartments, and at least one opening in communication with at least one of the at least two compartments, a common wall separating each of the at least two compartments wherein the common wall is adapted to be rupturable, and a rupture mechanism operatively engaged with the common wall and actuable by a user, wherein the rupture mechanism is adapted to rupture the common wall upon actuation by the user for enabling the contents of each of the at least two compartments to mix within the conjoined compartments of the container.

Referring to FIG. 1, a packaging container identified by reference numeral 10 is shown for one embodiment of the present invention. The packaging container 10 generally comprises a container 12 having a sidewall 14 and a neck 19 forming a top opening 16, and a closure cap 18 adapted to be threadedly engaged with the container neck 19. It is noted that the closure cap is not limited to those adapted for threaded engagement with the container neck 19, and may include other types of closure caps or sealing mechanisms including child-proof closure caps, snap-on closure caps, plastic seal films, and the like, capable of providing sealing engagement with the top opening 16, as would be known to one skilled in the art.

The container 12 further comprises an integral first compartment 20 adapted to hold a first substance 22, an integral second compartment 24 adapted to hold a second substance 26, and an optional integral third compartment 28 adapted to hold a third substance 30. In this embodiment of the present invention, the top opening 16 is configured to be in fluid communication with the first compartment 20. It will be understood that the present invention may include a single opening or multiple openings in communication with one or any combination of compartments in accordance with the present invention.

The first compartment 20 is generally defined by the sidewall 14 and a common wall or septum 32. The common wall 32 functions to separate the second and third compartments 24 and 28, respectively, from the first compartment 20. The second compartment 24 is generally defined by a portion of the common wall 32, a rear wall 34 joined to the inside surface of the sidewall 14 of the container 12, and a middle wall 36. The middle wall 36 separates the third compartment 28 from the second compartment 24. The third compartment 28 is generally defined by a portion of the common wall 32 and the middle wall 36.

As described above, the substances contained in each compartment may be selected from a range of materials or ingredients in accordance with the present invention, and such substances may be selected from fluids such as liquids or gases, flowable materials, mixable materials, particulates, gels, solids, aerosols, and the like where it would be desirable to maintain the component materials or substances in separate compartments within the container during storage, and when desirable, to facilitate rapid contact and mixing of the components with one another within the container for immediate dispensing and use thereof.

Optionally, the container 12 may further include second and third openings 38 and 40, respectively. In one embodiment of the present invention, the container 12 can further include a second neck 43 forming a second opening 38, which is in fluid communication with and provides a top opening for the second compartment 24, to permit passage of the substance 26 into the second compartment 24. The container 12 can further include a neck 45 forming a third opening 40, which is in communication with and provides a top opening for the third compartment 28, to permit passage of the substance 30 into the compartment 28. The packaging container 10 may further include a second cap 42 and a third cap 44 configured for threaded or other sealing engagement with the corresponding necks 43 and 45, respectively, to seal the top openings 38 and 40, respectively.

The container 12 further includes a rupture mechanism 46 that is adapted to rupture or rip open the common wall 32 upon appropriate actuation by the user as will be further described below. When the common wall 32 is ruptured, the second and third substances 26 and 30 are released from the corresponding second and third compartments 24 and 28, respectively, for contacting and mixing with the substance 22 contained within the first compartment 20 to yield the final product. The mixing takes place in the volume formed by the conjoined compartments 20, 24 and 28. Thereafter, the resulting product may then be conveniently dispensed through the opening 16. It is noted that as previously mentioned, other embodiments of the present invention can include two compartments, such as compartments 20 and 24, or compartments 20 and 28, for example.

In the present embodiment of the present invention, the rupture mechanism 46 comprises an elongate member 48 selected from a thread, a filament, a tape, a strand, a cord, or a strip of flexible material in the form of a tether line having a first end 50 and a second end 52, and a tear strip 54 operatively engaged with the common wall 32 along a tear portion 56 which extends longitudinally along the surface of the common wall 32. The first end 48 of the elongate member 46 is securely attached to an end portion of the tear strip 54, and the second end 50 of the elongate member 46 is securely attached to an inside portion of the closure cap 18. The tear strip 54 is operatively engaged with the common wall 32 as to cause the common wall 32 to split along the tear portion 56 when the tear strip 54 is drawn away and separated from the common wall 32. The common wall 32 can be provided by any suitable material such as thin walled plastic films, whereby the wall material must be at least substantially non-reactive to the substances stored in the container 10.

It is noted that the rupture mechanism is not limited to the form described herein and may include other means for causing an intact wall to rupture or break open as would be known to one skilled in the art.

As previously noted above, the packaging system of the present invention may be constructed with any number of compartments suitable for accommodating a corresponding number of ingredients or components, which when mixed together will produce the desired product. The volume of the compartments may also vary depending on the ratio amounts of each component to be mixed prior to use to yield the final form of the product.

The individual parts of the packaging container 10 can be fabricated from any one or a combination of suitable materials, preferably materials that are durable and compatible with the component substances. Such suitable materials include, but are not limited to glass, plastic, metal, and the like.

Figure 2:
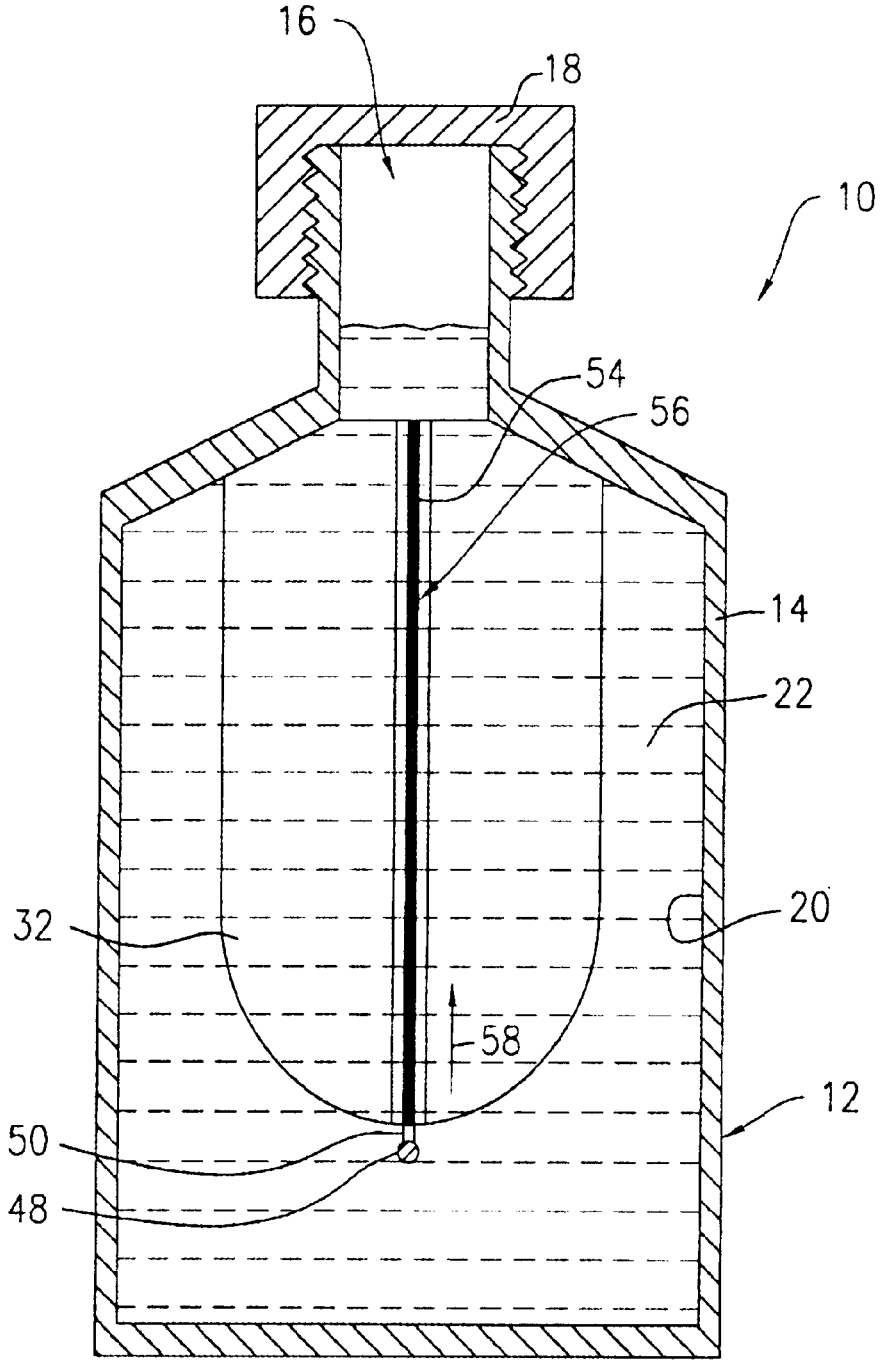
FIG. 2 is a cross sectional view of the container along lines 2—2 of FIG. 1.

Referring to FIG. 2, a cross sectional view along 2—2 of FIG. 1 further shows details of the placement of the tear strip 54 extending longitudinally along the tear portion 56 on the common wall 32. In the present embodiment, the tear strip 54 and the elongate member 48 are arranged so that the tear strip 54 can be drawn in an upward direction along arrow 58 from a lower end to an upper end of the common wall 32. Once the tear strip 54 is pulled away from the common wall 32 and extracted from the container 12, the tear strip 54 provides a visual cue to the user that the product is activated for use.

In a further embodiment of the present invention, the packaging container 10 can be more particularly adapted to contain a multiple component decontaminating agent such as DECON GREEN™ which is under development by the U.S. Army Edgewood Chemical Biological Center of Aberdeen Proving Ground, Maryland. DECON GREEN™ is an environmentally friendly decontamination solution useful for neutralizing harmful chemical agents through peroxide activation, and more preferable over currently used decontaminating agents such as Decontaminating Solution Number Two (DS2), which are typically composed of toxic and highly corrosive or environmentally incompatible substances. DECON GREEN™ is composed of three active chemical components: an organic solvent such as propylene carbonate, propylene glycol, and the like, a peroxide such as hydrogen peroxide, urea peroxide, and the like, and a solid powdered catalyst such as potassium carbonate, potassium molybdate and the like. The chemical components of DECON GREEN™ when mixed together are generally incompatible for prolonged storage, and must be maintained separate and apart from one another prior to use.

The packaging container of the present invention is particularly well-suited for separately holding the components of such products apart until use, and is especially suitable for use in situations where the need for such products may arise particularly under difficult and urgent conditions (e.g., biological or chemical attack). As noted above, the packaging of the present invention effectively permits a user to quickly activate the product by facilitating rapid mixing of the components with minimal preparation steps or mental deliberation on the part of the user.

In a further embodiment of the present invention, the first compartment 20 can be adapted to contain an organic solvent as the substance 22. The second compartment 24 can be adapted to contain a peroxide as the substance 26. The third compartment 28 can be adapted to contain a catalyst in the form of a solid particulate as the substance 30. Each of the compartments 20, 24 and 28, respectively, can be suitably sized to contain the proper amounts of the components to be mixed. Preferably, the ratio of the amounts of the organic solvent to the peroxide to the catalyst ranges from about 70%–60% to 25%–30% to 5%–1%.

In the further embodiment of the present invention, the cap 42 of the second compartment 24 containing the peroxide 26 can be an industry-standard pressure relief cap comprising a pressure relief valve 60, which is adapted to release any excess oxygen gas generated by the decomposition of the peroxide 26 during storage. The opening 38 permits the peroxide 26 to be conveniently loaded into the second compartment 24. Since the peroxide 26 gradually decomposes over time, the opening 38 also allows the peroxide 26 to be replaced with a fresh stock. Since the catalyst 30 can be stored indefinitely, the cap 44 may be permanently fixed to the opening 40. The packaging container 10 can further include simple to follow instructions for procedures on activating the DECON GREEN™, preferably located on an external portion of the container 12.

To ensure that the packaging container of the present invention remains intact during shipping and storage, it would be preferable to fabricate the exterior of the container 12 with highly impact resistant and puncture resistant materials such as plastic. In this embodiment, since the second and third compartments 24 and 28 are located within the first compartment 20, the second and third compartments 24 and 28 do not need to be highly impact resistant and puncture resistant as the exterior portion of the container 12. The location and arrangement of the second and third compartments 24 and 28 within the first compartment 20 provides sufficient protection against accidental puncturing or breakage. In the event, that the packaging container 10 is subjected to rough handling, the contents (e.g., peroxide) of the second compartment 24 may be safely released into the first compartment 20 where it is harmlessly retained and diluted within the container, thus avoiding or preventing a major hazard that may otherwise occur in an external spill.

With reference to FIGS. 1 and 2, the overall operation of the packaging of the present invention will be described. To activate the product packaged in the packaging container 10, the user simply removes the closure cap 18 from the top opening 16. The user pulls the closure cap 18 away from the container 12 to extract the elongate member 48 out of the container top opening 16. As the elongate member 48 is drawn out of the container 12, the tear strip 54 is pulled away from the common wall 32 along the tear portion 56 in the direction of arrow 58. As the common wall 32 ruptures, the components contained in the compartments 20, 24 and 28 are released to contact and mix together with one another to yield the final desired mixed product for immediate dispensing and use. It is noted that after the elongate member 48 is pulled away as indicated, the cap 18 can be reinstalled onto the neck 19 for sealing the top opening 16, permitting the container 10 to be shaken to ensure through mixing of the active ingredients or components.

The forgoing discussion discloses and describes merely exemplary embodiments of the present invention. One skilled in the art will readily recognize from such discussion, the drawings, and from the accompanying claims, that various changes, modifications, and variations can be made therein without departing from the spirit and scope of the invention as defined in the following claims.

What is claimed is:

1. A packaging system comprising:

a container including at least two compartments, and at least one opening in communication with at least one of the at least two compartments;

a closure cap adapted for sealing engagement with the at least one opening of the container;

a common wall separating each of the at least two compartments, the common wall being adapted for rupturing to enable the contents of each of the at least two compartments to mix in a volume formed from the resulting conjoined compartments within the container, and a rupture mechanism operatively engaged with the common wall and actuable by a user, the rupture mechanism being adapted for rupturing the common wall upon actuation by the user;

wherein the rupture mechanism comprises a tear strip operatively engaged with the common wall, said tear strip extending longitudinally along the common wall to yield a tear portion wherein the separation of the tear strip from the common wall causes the common wall to split along the tear portion; and an elongate member having a first end and a second end, the first end of the elongate member being securely attached to the tear strip, and the second end of the elongate member is securely attached to the closure cap.

2. The packaging system of claim 1, wherein the elongate member is selected from a group consisting of a thread, a strand, a filament, a cord, a tape, and a strip.

3. The packaging system of claim 1, wherein the closure cap is adapted for threaded engagement with the at least one opening of the container.

4. The packaging system of claim 1, wherein the closure cap includes a pressure relief valve.

5. The packaging system of claim 1, wherein the at least two compartments are adapted to retain a substance selected from the group consisting of fluids, gases, liquids, solids, powders, particulates, gels, aerosols, dissolvable solids, effervescent solids and mixtures thereof.

6. The packaging system of claim 1, wherein said container further includes first, second and third compartments, and said common wall separates the compartments from one another.

7. A packaging system comprising:

a container having at least two compartments and an opening in communication with at least one of the at least two compartments, each of said compartments being adapted for holding a substance;

a closure cap adapted for sealing engagement with the opening of the container;

a common wall partitioning each of the compartments from one another;

a tear strip extending along at least a portion of the common wall wherein the separation of the tear strip from the common wall will cause the compartments to become conjoined to yield a volume in which the substances can mix; and an elongate member having first and second ends, the first end of said elongate member being attached to the tear strip, and the second end of said elongate member is attached to the closure cap.

8. The packaging system of claim 7, wherein the container includes a first compartment, a second compartment, and a third compartment.

9. The packaging system of claim 8, wherein the opening of the container is in communication with the first compartment.

10. The packaging system of claim 8, wherein the first compartment is adapted to hold a solvent, the second compartment is adapted to hold a peroxide and the third compartment is adapted to hold a catalyst.

11. The packaging system of claim 10, wherein the solvent is selected from the groups consisting of propylene carbonate and propylene glycol.

12. The packaging system of claim 10, wherein the peroxide is selected from the groups consisting of hydrogen peroxide and urea peroxide.

13. The packaging system of claim 10, wherein the catalyst is selected from the groups consisting of potassium carbonate and potassium molybdate.

14. The packaging system of claim 10, wherein the first, second and third compartments are each sized to provide a mixing ratio of from about 70%–60% to 25%–30% to 5%–1%.

15. The packaging system of claim 8, wherein the second and third compartments are located within the first compartment.

16. The packaging system of claim 7, wherein the container is composed of a highly impact and puncture proof material.

* * * * *